US006134991A

United States Patent [19]

Chaconas

[11] Patent Number: 6,134,991

[45] Date of Patent: Oct. 24, 2000

[54] PAWL FOR RATCHET WRENCH

[75] Inventor: Peter Constantine Chaconas, Glyndon, Md.

[73] Assignee: Hand Tool Design Corporation, Wilmington, Del.

[21] Appl. No.: 09/262,644

[22] Filed: Mar. 4, 1999

[51] Int. Cl.[7] ..... B25B 13/46

[52] U.S. Cl. ..... 81/63; 81/63.2

[58] Field of Search ..... 81/62, 63, 63.2, 81/58.4

[56] References Cited

U.S. PATENT DOCUMENTS

| | | | |
|---|---|---|---|
| 3,824,881 | 7/1974 | Wright | 81/63 |
| 4,261,233 | 4/1981 | Konecny | 81/62 |
| 4,485,700 | 12/1984 | Colvin | 81/62 |
| 4,631,988 | 12/1986 | Colvin | 81/62 |
| 5,000,066 | 3/1991 | Gentiluomo | 81/62 |
| 5,076,121 | 12/1991 | Fosella | 81/58.4 |
| 5,178,047 | 1/1993 | Arnold et al. | 81/63.2 |
| 5,522,288 | 6/1996 | Slusar et al. | 81/63 |
| 5,957,009 | 9/1999 | McCann | 81/63.2 |

*Primary Examiner*—James G. Smith
*Assistant Examiner*—Hadi Shakeri
*Attorney, Agent, or Firm*—Leonard Bloom

[57] ABSTRACT

A pawl for use in a ratchet wrench having a ratchet gear in an opening and the pawl in a communicating pawl opening. A detent ball and spring are in a bore in the wrench communicating with the pawl opening. A relief surface is formed on each side surface of the pawl extending from the front surface of the pawl toward the back surface. The front surface of the pawl has an intermediate surface having opposite ends forming teeth. A tooth is formed on the approximate mid-point of the intermediate portion. The back face of the pawl has two pockets separated by a center ridge. Each pocket has a ramp near the center ridge, each ramp joins a concave portion. A furrow is formed in at least one pocket extending from the bottom surface of the pawl to a point opposite the bore for the detent spring such that the detent ball may be introduced into the furrow and directed into the bore. A spacing hub is formed on the pawl to minimize friction between the pawl and the cover plate.

40 Claims, 14 Drawing Sheets

PAWL FOR RATCHET WRENCH

BACKGROUND OF THE INVENTION

The present invention relates to a pawl for a ratchet wrench and, more particularly, to a pawl with additional teeth, dirt accommodating and friction reducing features and specifically configured pockets.

Most ratchet wrenches have a pawl with teeth on a front face to engage teeth on a ratchet gear and a pair of pockets on a back face to engage a detent means mounted in a blind bore in the handle and communicating with the pawl opening. The assembly of the wrench usually requires special tooling to retain the ball and spring detent means within the blind bore when the pawl is being inserted into the pawl opening. Additionally, when dirt enters the opening in the head of the wrench, pawl motion is impaired and the teeth are unable to fully engage, reducing the torque capacity of the ratchet.

U.S. Pat. Nos. 4,261,233, 4,631,988 and 5,000,066 disclose ratchet wrenches with different types of pawls and detent means which are known to persons skilled in the art. All of these pawls accumulate dirt which can cause damage to the pawl and the ratchet gear when the ratchet is loaded.

BRIEF SUMMARY OF THE INVENTION

It is an object of the present invention to provide a ratchet wrench with a pawl which has reduced collection of dirt between the pawl teeth and ratchet gear teeth such that the ratchet wrench can carry its rated torque load when dirty.

It is a further object of the present invention to provide a pawl which facilitates assembly of the detent ball into the bore in the handle avoiding the use of special tools.

In accordance with the teachings of the present invention, it there is disclosed a pawl for use in a ratchet wrench having a handle and a head connected thereto. The ratchet wrench has an opening in the head of the ratchet wrench, the opening having an inner wall. A ratchet gear and a pawl are disposed in the opening juxtapositioned to one another with the pawl proximal to the handle. A detent means is provided contacting the pawl to urge the pawl into engagement with the ratchet gear. The pawl has a front face having at least a first tooth and a spaced-apart at least a second tooth, a back face having a pair of adjacent pockets separated by a center ridge, and a pair of opposite side surfaces between the front face and the back face. The teeth on the front face adjoin the respective side surfaces. Each side surface of the pawl has a relief surface formed thereon, the respective relief surfaces each extending from the front face of the pawl to approximately a mid-point between the front face and the back face of the pawl. The relief surfaces provide increased forward radial clearance between the respective relief surfaces and the inner wall of the opening in the head. In this manner, dirt within the head of the wrench between the respective relief surfaces and the wall of the opening in the head is less frictionally effective, such that wear and damage to the sets of pawl teeth and the ratchet gear is reduced. The relief surfaces promote translational movement of the pawl within the pawl opening.

Additionally, there is disclosed a pawl for use in a ratchet wrench having a handle and a head connected thereto. The ratchet wrench has an opening in a head of the ratchet wrench. A ratchet gear and a pawl are disposed in the opening juxtapositioned to one another with the pawl proximal to the handle. A detent means is provided contacting the pawl to urge the pawl into engagement with the ratchet gear.

The pawl has a front face having a first set of teeth and a spaced-apart second set of teeth, a back face having a pair of adjacent pockets separated by a center ridge, and a pair of opposite side surfaces between the front face and the back face. An intermediate surface is formed on the front face of the pawl between the sets of teeth, the intermediate surface having opposite ends adjacent to the respective sets of teeth. The opposite ends of the intermediate surface form respective teeth. The teeth on the opposite ends of the intermediate surface respectively initially engage the ratchet gear when the wrench is used in a forward and a reverse direction. The teeth on the opposite ends of the intermediate surface act at a greater effective radius as compared to the respective sets of teeth on the front face of the pawl. In this manner enhanced relative torque is provided to the pawl to supplement the action of the detent means.

Furthermore, there is disclosed a pawl for use in a ratchet wrench, the ratchet wrench having a handle connected to a head. The ratchet wrench has a ratchet gear opening and a communicating pawl opening in the head of the ratchet wrench. A bore is formed in the handle communicating with the pawl opening. A ratchet gear is disposed in the ratchet gear opening and a pawl is disposed in the pawl opening. The pawl has a front face having a first set of teeth and a spaced-apart second set of teeth, a back face having a pair of adjacent pockets separated by a center ridge and a pair of opposite side surfaces between the front face and the back face. At least one furrow is formed on the back face of the pawl. The at least one furrow extends from a bottom surface of the pawl towards a top surface of the pawl. The at least one furrow has an innermost surface curved outwardly toward the back face of the pawl. The pawl in the opening may be moved away from the handle. The at least one furrow is aligned with the bore in the handle. A detent ball may be introduced into the at least one furrow. The detent ball descends to the curved innermost surface and is directed into the bore in the handle in which is a spring has been pre-positioned. In this manner, the pawl may be moved to capture the ball in the bore and special tools to insert the detent means in the bore are avoided.

Also disclosed is a pawl for use in a ratchet wrench having a handle and a head connected thereto. An opening is formed in the head of the wrench. A ratchet gear and a pawl are disposed adjacent to one another in the opening. The pawl has an upper surface and a lower surface. An axial opening is formed in the upper surface of the pawl to receive therein a reversing lever. A spacing hub is formed on the lower surface of the pawl at approximately a center of the lower surface. A cover plate is provided to cover the opening in the head of the ratchet wrench to retain the socket gear and the pawl within the opening. The spacing hub on the pawl contacts the cover plate and minimizes friction between the pawl and the cover plate.

These and other objects of the present invention will become apparent from a reading of the following specification taken in conjunction with the enclosed drawings.

BRIEF DESCRIPTION OF THE DRAWINGS

FIG. 13 shows the initiation of drive engagement.

FIG. 14 shows the pawl being seated and pawl teeth beginning engagement with the gear teeth.

FIG. 15 shows the pawl almost fully engaged.

FIG. 19 is the initial stage of the backswing.

FIG. 20 is the intermediate stage of the backswing.

FIG. 21 is the end of the backswing.

DESCRIPTION

Figure 1:
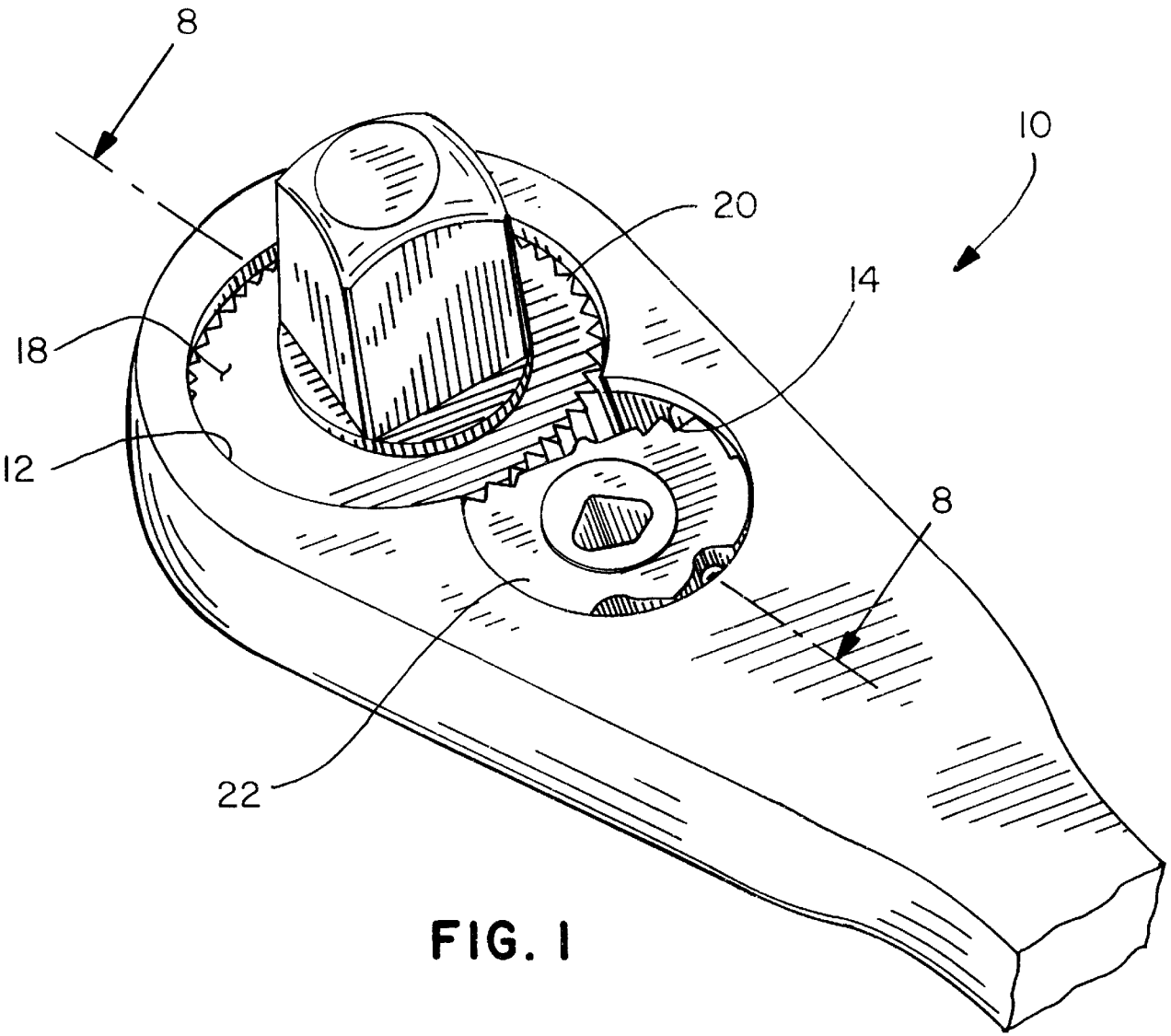
FIG. 1 is a perspective view of the ratchet wrench of the present invention with the bottom cover plate removed to show the ratchet gear and pawl.

Referring now to FIGS. 1–11, the ratchet wrench 10 has a handle 11, a head with a ratchet gear opening 12 and a pawl opening 14 formed therein. The opening has an inner wall 15. Preferably, the openings overlap one another and define a waist or interface 16 having a width. However, the opening may be a single opening to accommodate a ratchet gear 18 and a pawl 22. The ratchet gear 18 is disposed in the ratchet gear opening 12. The ratchet gear 18 has a plurality of axial teeth 20 formed about the circumference of the ratchet gear 18 (FIG. 1).

The pawl 22 is disposed in the pawl opening 14 juxtapositioned to the ratchet gear. As shown in FIGS. 2–6, the pawl 22 has a front face 24 with a first set of teeth 26 and a spaced-apart second set of teeth 26' formed thereon. The sets of teeth 26, 26' may consist of at least a first tooth 42 and one or more teeth 44 in the first set 26 and at least a second tooth 42' and one or more teeth 44' in the second set 26'. The pawl 22 has a back face 28 which has a pair of adjacent pockets 30 separated by a center ridge 32. The pawl 22 has a pair of opposite side surfaces 34 between the front face 24 and the back face 28. The front face 24 of the pawl 22 has an intermediate portion 36 formed thereon between the sets of teeth 26, 26'. The intermediate portion 36 may be arcuate or non-arcuate. The intermediate portion 36 has opposite ends 38 which are adjacent to the respective sets of teeth 26, 26'. The opposite ends 38 form respective teeth which engage the teeth 20 on the ratchet gear as will be described. Further, a tooth 40 is formed at the approximate mid-point of the intermediate portion 36. Preferably, the tooth 40 extends the full height of the pawl. The first set of teeth 26 and the second set of teeth 26' on the pawl 22 each have a first tooth 42, 42' proximal and rearward of the portion 36 and preferably, each also has at least a spaced-apart second tooth 44, 44' which is distal from the intermediate portion 36 and rearward of the first tooth 42, 42'.

In a preferred embodiment (FIG. 4) the pawl 22 has a first portion 46 of the side surface 34 adjoining the teeth 26, 26' which is formed at a first radius r1 from the center of the pawl 22 defining a front portion of the side surfaces 34. A second portion adjoining the pockets 30 is formed at a second radius r2 from the center of the pawl defining a back portion of the side surfaces 34. Radius r2 is greater than radius r1 such that a relief surface 46 is formed on each side surface 34 of the pawl 22.

Figure 4:
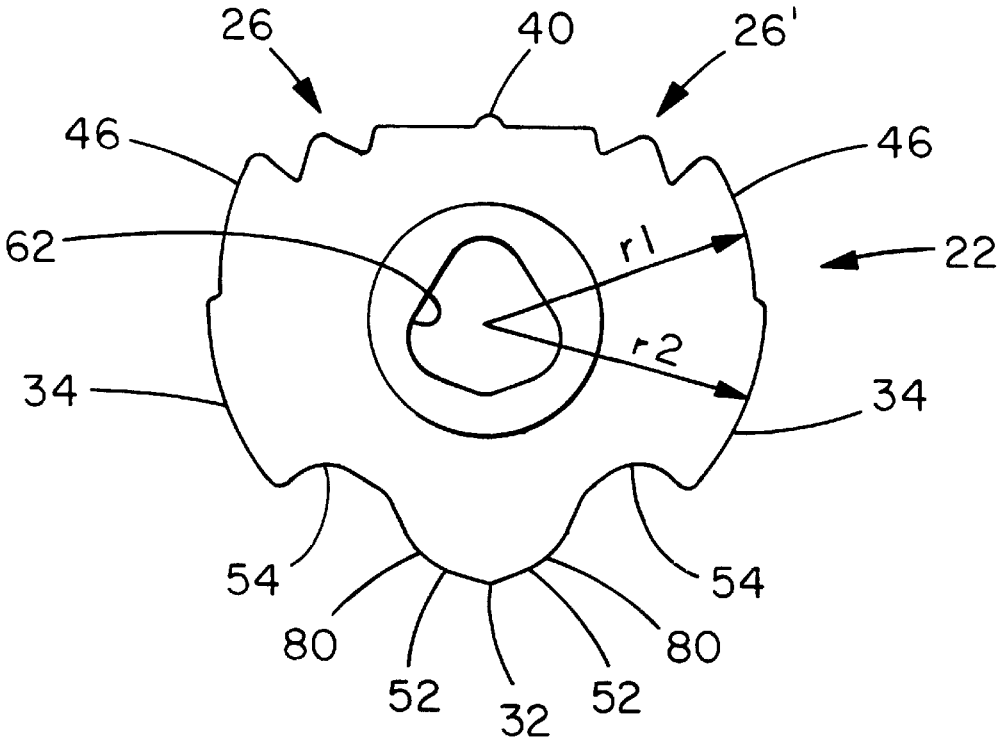
FIG. 4 is a bottom plan view of the pawl of the present invention.
Figure 4A:
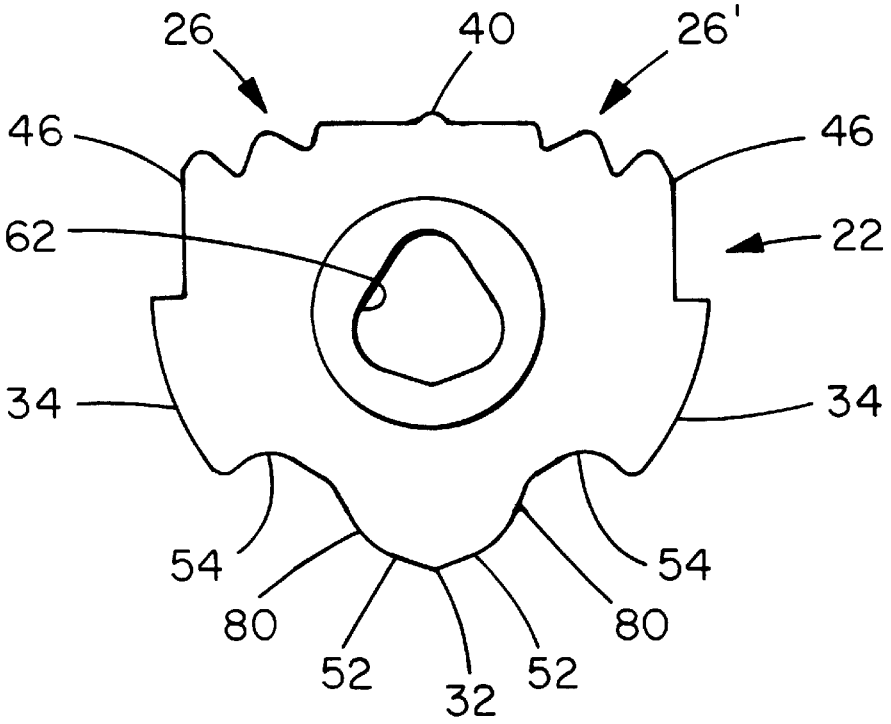
FIG. 4A is a bottom plan view of another embodiment of the pawl.

In another embodiment (FIG. 4A), the first portion 46 of the side surface 34 is formed as a straight edge between the front face 24 of the pawl 22 and the second portion of the side surface 34. The first portion 46 is not arcuate as in FIG. 4.

Figure 5:
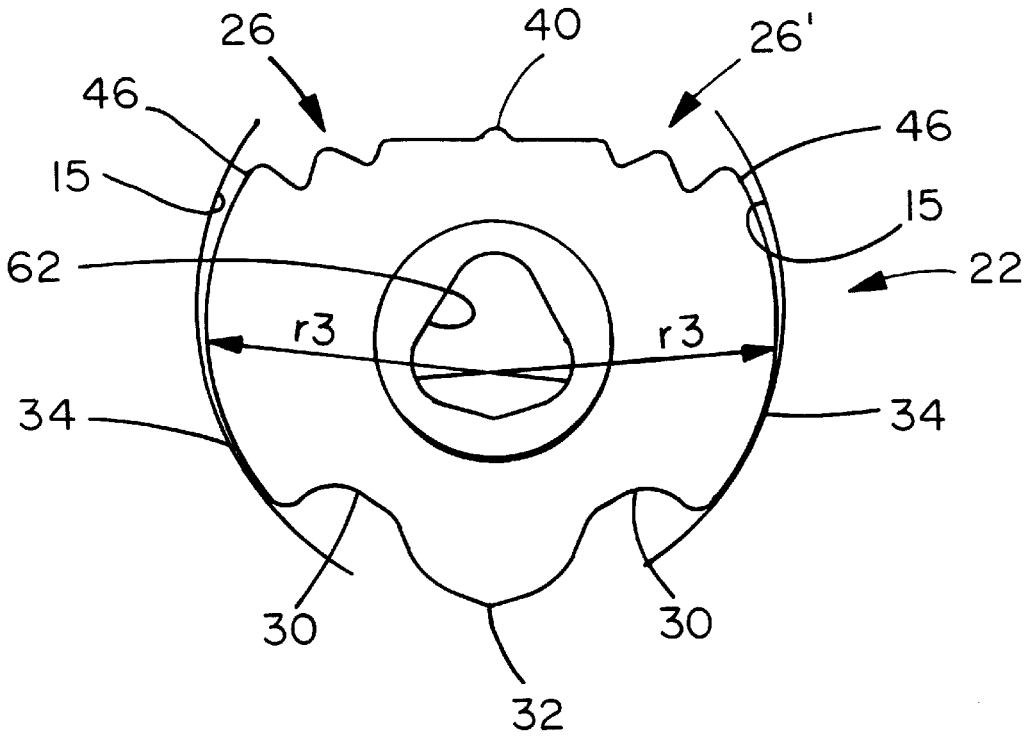
FIG. 5 is a bottom plan view of the pawl of the present invention disposed in the opening in the head and showing a radius having an origin disposed from the center of the pawl.
Figure 6:
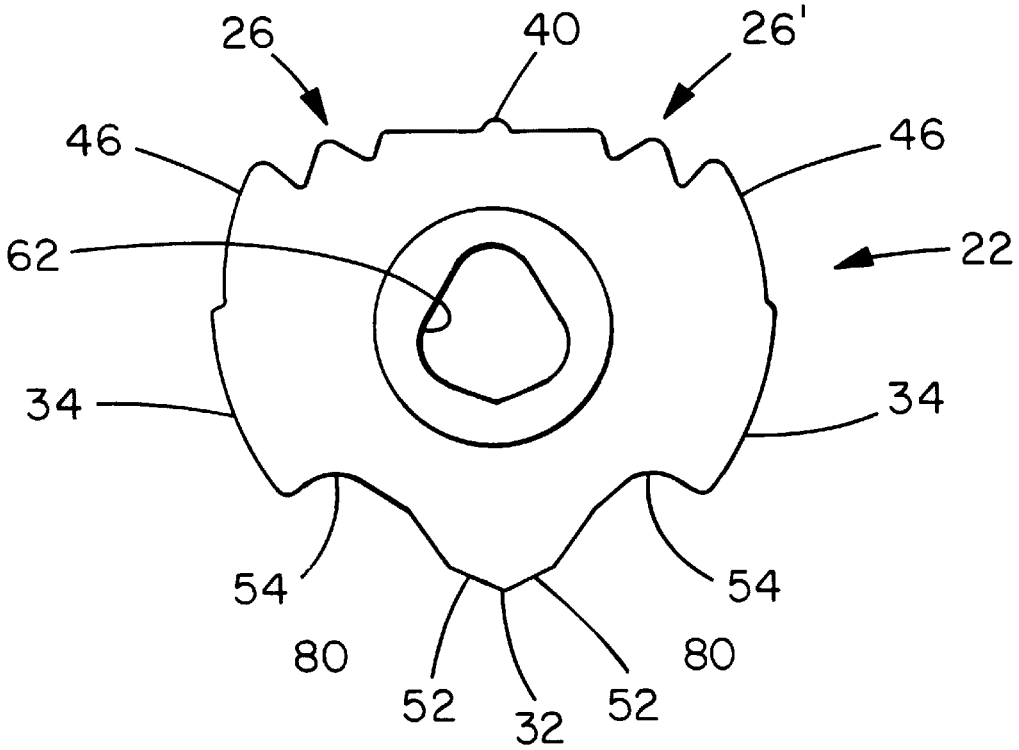
FIG. 6 is a bottom plan view of an alternate embodiment wherein the ramp in the pocket is formed from a plurality of non-arcuate segments.

Alternately, the side surfaces 34 of the pawl 22 may be formed having a single radius r3 which has an origin displaced from the center of the pawl (FIG. 5). The side surfaces 34 near the pockets 30 are adjacent to the inner wall 15 of the opening 12 in the head of the ratchet wrench 10 but the side surfaces 34 near the front face 24 are spaced apart from the inner wall of the opening 12 to form the relief surfaces 46.

Figure 10:
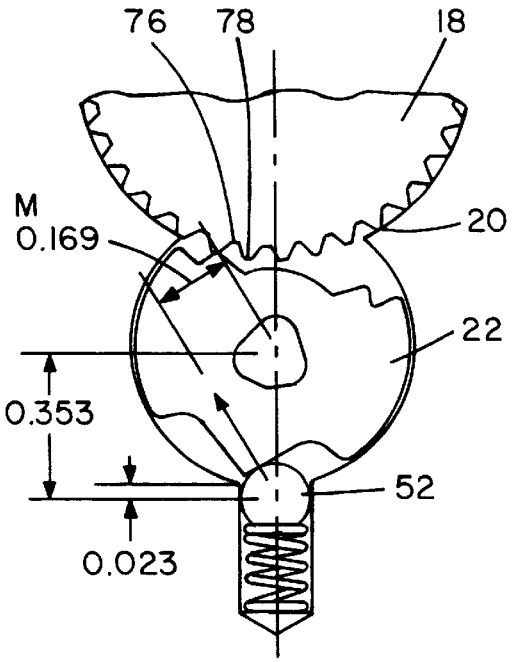
FIG. 10 PRIOR ART
FIG. 10 is a top plan view of the prior art showing the position of the ball detent in the back swing position.

In a preferred embodiment, the respective relief surfaces 46 extend from the front face 24 of the pawl 22 to approximately the mid-point between the front face 24 and the back face 28 of the pawl 22. The relief surfaces 46 serve to accommodate dirt and dust which may enter the wrench that would otherwise cause binding and friction between the pawl 22 and the inner wall 15 of the opening 12 in the head. This reduces poor engagement between the pawl teeth 26, 26' and the ratchet gear teeth 20. Preferably, the relief surfaces 46 extend between the top surface 48 of the pawl 22 and the bottom surface 50 of the pawl. The relief surfaces 46 provide increased forward radial clearance between the respective relief surfaces 46 on both sides of the pawl 22 and the inner wall 15 in the opening 12 in the head. Also, it is preferred that the teeth 42, 44, which constitute the sets of teeth 26, 26' on the front face 24 of the pawl 22, have a rounded apex surface. The teeth 20 on the ratchet gear 18 each have a gullet 76 and a peak 78 (FIG. 10). The apex surface of the pawl teeth 42, 44 are truncated and rounded. When the pawl teeth 42, 44 are in the normally fully engaged position, there is clearance between the apex of the pawl teeth 42, 44 and the gullet 76 of the gear teeth 20. Partial engagement due to dirt accumulation in the gullet 76 is avoided because the dirt and dust is more easily extruded from between the teeth 26, 26' of the pawl 22 and the teeth 20 on the ratchet gear 18 bringing the pawl teeth 26, 26', and the gullet 76 into further engagement with one another.

Because the relief surfaces 46 on the pawl 22 and the configuration of the sets of teeth 26, 26' on the front face 24 of the pawl 22 produce a pawl 22 which has a first or front portion 46 smaller than a conventional pawl (see the broken line outline of a prior art pawl in FIG. 3), the pawl 22 of the present invention may move translationally as well as rotationally within the pawl opening 14. In order to assure that positive contact is made between the sets of pawl teeth 26, 26' and the teeth 20 on the ratchet gear 18, each pocket 30 in the back face 28 of the pawl 22 has a specially configured ramp 52 formed therein. The ramps 52 adjoin the center ridge 32 and extend inwardly into the respective pocket 30. The ramp 52 may be arcuate, may be a plurality of non-arcuate portions at an obtuse angle to each other (FIG. 6) or may be a combination of arcuate and non-arcuate portions. The respective ramps 52 extend from the center ridge 32 to a concave portion 54 of each pocket 30. Each concave portion 54 terminates at the respective side surface 34 of the pawl 22. Preferably, each pocket 30 further has a non-arcuate portion 80 disposed between the convex ramp 52 and the concave portion 54. This non-arcuate portion 80 is at an angle of approximately 24° with respect to the center line through the pawl 22. The detent spring 58, which is disposed in the bore 60 in the handle of the wrench communicating with the pawl opening 14, urges the detent ball 56 against the ramp 52 and the non-arcuate portion 80 to produce torque and translational force to the pawl 22. The teeth 26, 26' are urged into positive engagement with the teeth 20 on the ratchet gear 18.

Figure 8:
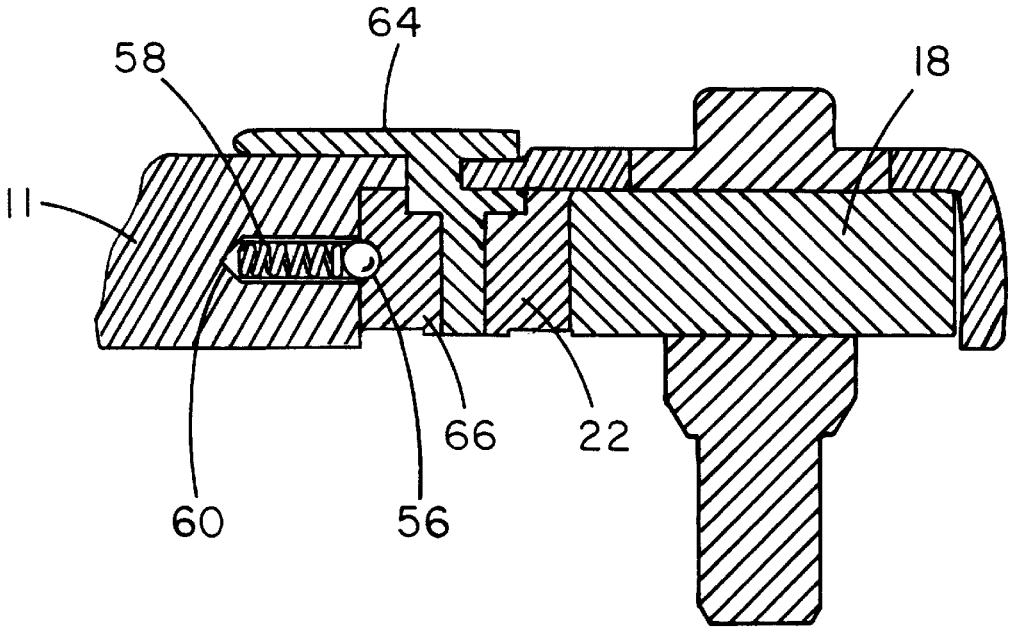
FIG. 8 is a cross-sectional view taken across the lines 8—8 of FIG. 1.

The pawl 22 further has an opening or bore 62 formed therein, preferably as a through hole between the top surface 48 and the bottom surface 50 of the pawl 22 (FIG. 8). The stem of a reversing lever 64 is received in the opening 62. It is preferred that the stem be keyed to the opening 62 by a keying means or by having a non-cylindrical shape which cooperates with the non-cylindrically shaped, cooperating axial opening 62. The reversing lever 64 extends above the top surface of the head of the wrench and can be manually moved between a first position and a second position. Such movement rotates the pawl 22 to a corresponding first position and second position resulting in the detent ball 56 being disposed in one or the other pockets 30 on the back face 28 of the pawl 22. In this manner, the wrench can ratchet in a forward or reverse direction.

Figure 9:
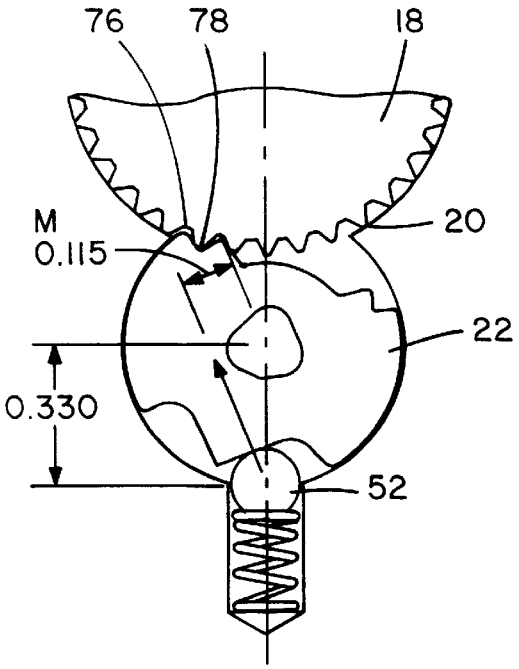
FIG. 9 PRIOR ART
FIG. 9 is a top plan view of prior art showing the position of the ball detent with the pawl in the engaged position.

Referring to FIG. 9, in a wrench having a conventional pawl, when the pawl is engaged with the ratchet gear teeth, the initial deflection of the spring in the bore is 0.050 inches. The spring rate is 5.53 lb./in. providing a detent force against the pawl of 0.2765 lb. (5.53×0.050). The torque applied to the pawl by the detent force is the detent force (0.2765) multiplied by the moment arm M (0.115) and is equal to 0.0317 in. lb.

FIG. 10 shows the conventional pawl in the backswing mode of operation of the wrench. Due to rotation of the pawl, the detent ball is engaged in the pocket closer to the center ridge of the pawl and is deflected an additional 0.023 in. into the bore (0.353−0.330=0.023). Thus, the detent force is 5.53×(0.023+0.050)=0.404 lb. The moment arm M (0.169) times the detent force (0.404) produces a pawl torque of 0.0683 in. lb. The maximum pawl torque produced by the detent during backswing is 2.15 times (0.0683/0.0317) greater than the torque produced when the pawl is engaged.

Figure 11:
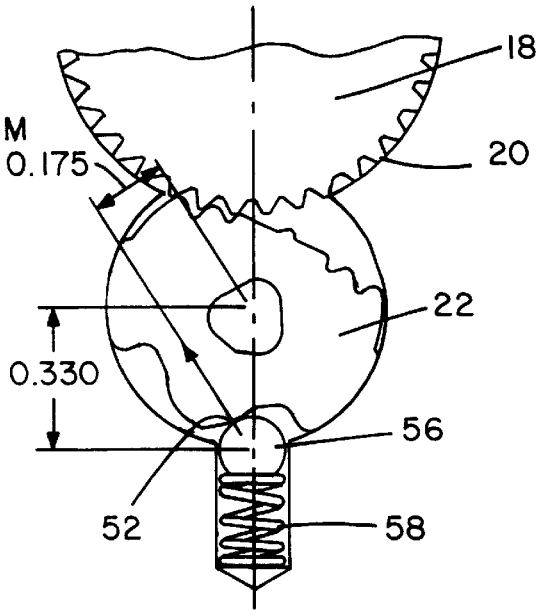
FIG. 11 is a top plan view of the present invention showing the position of the ball detent with the pawl in the engaged position.

FIG. 11 is an engagement mode view of the present invention comparable to the conventional pawl of FIG. 9. The detent force against the pawl is the same as with the conventional pawl (0.2765 lb.). The moment arm M is 0.175 in. producing a pawl torque of 0.0484 in. lb. compared to the pawl torque of 0.0317 in. lb. for the conventional pawl. Thus, the present invention provides approximately 50% greater pawl torque than the conventional pawl.

Figure 12:
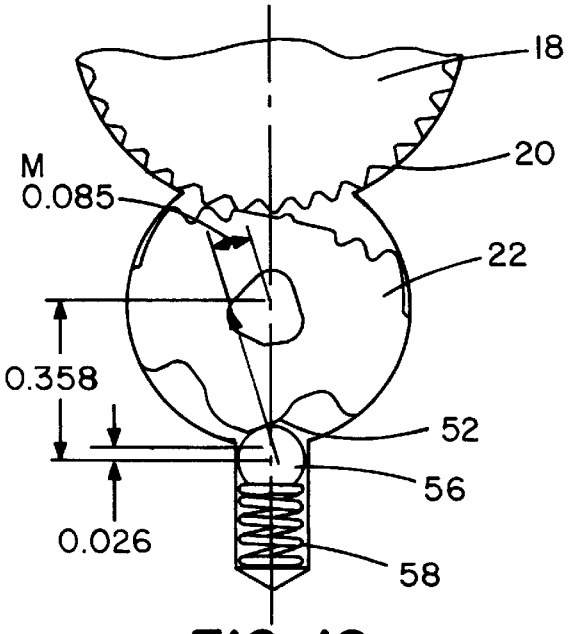
FIG. 12 is a top plan view of the present invention showing the position of the ball detent in the back swing position.

FIG. 12 is a backswing mode view of the present invention comparable to the conventional pawl in FIG. 10. Due to the structure of the ramp 52, the additional deflection of the spring is 0.026 in. The detent force is 5.53×. (0.026+0.050)=0.420 lb. The moment arm M is 0.085 and the pawl torque is 0.0357 in. lb. (0.08×. 0.420). The maximum pawl torque produced during backswing is approximately ¾ (0.0357/0.0484) of the torque produced when the pawl is engaged as compared to a value of 2.15 for a conventional pawl.

Thus, the present invention provides not only greater torque than the conventional pawl during engagement, but also provides significantly reduced backswing torque as compared to a conventional pawl. This is especially important since high backswing torque is undesirable.

Figure 13:
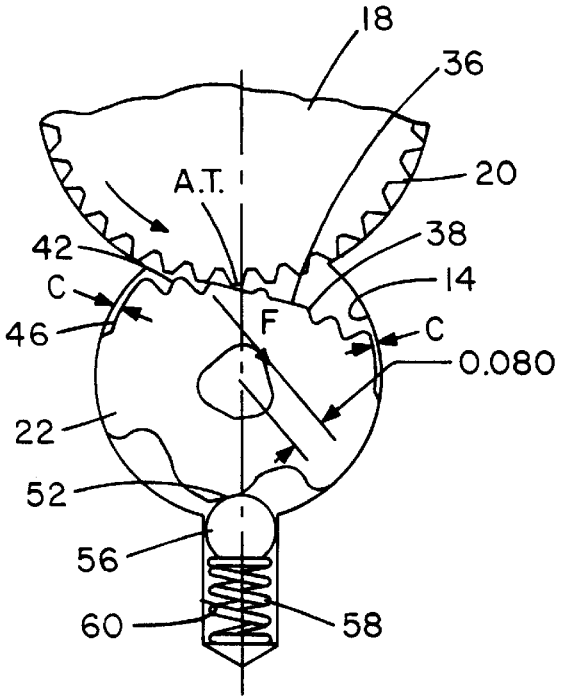
FIGS. 13–15 are a sequence of top plan views showing drive engagement of the pawl of the present invention with the ratchet gear.
Figure 14:
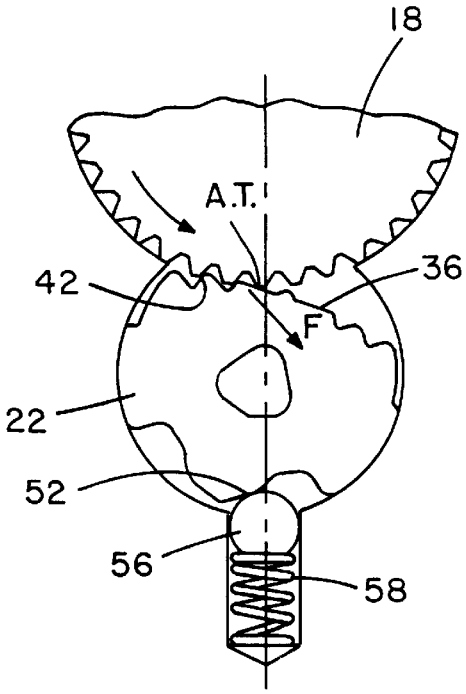
Figure 15:
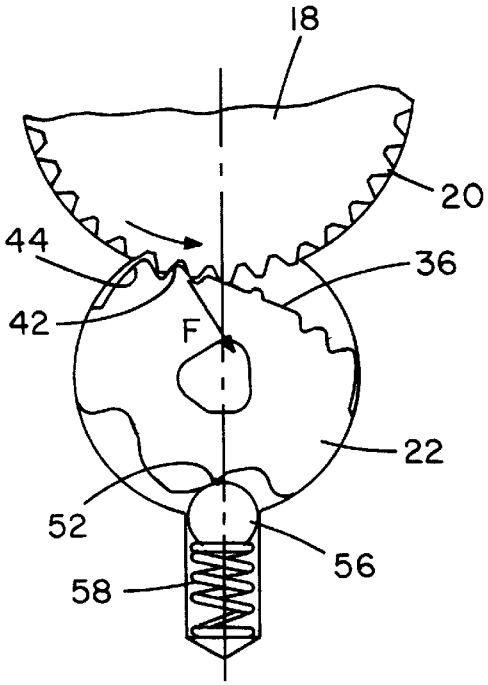

As shown in FIGS. 13–15, clearance C is provided by the relief surfaces 46 between the pawl 22 and the opening 14 in the head of the wrench. This clearance C allows the pawl 22 to move toward the gear 18 under the urging of the ball 56 and spring 58 detent means. This provides translational movement to the pawl 22 in addition to the rotational movement. The adjacent tooth A.T. on the gear contacts the intermediate portion 36 to limit premature engagement of the pawl tooth 42. The direction of the transmitted force F is spaced apart approximately 0.080 in. from the center of the pawl. This provides enhanced rotative torque to augment the pawl engagement torque produced by the detent means. As the pawl 22 is being seated (FIG. 14) the adjacent tooth A.T. continues to bear on the intermediate portion 36 and, in combination with the ends acting as teeth, properly times the engagement of the pawl tooth 42. The angle between the transmitted force F and the center line of the wrench has increased producing greater pawl rotation torque. The detent ball 56 has moved to a higher torque producing portion of the ramp 52 in the pocket of the pawl producing increased pawl torque. When the pawl is almost fully engaged with the gear 18 (FIG. 15) increased torque is required to engage the distal pawl tooth 44. However, transmittal force F has diminished due to a decreased angle of the transmittal F with respect to the center line of the wrench. The increased torque is produced by the detent ball 56 acting on the most torque producing portion of the ramp 52. The above mode of action is identical when the reversing lever 64 is in either the forward or reverse position and the ball is in the adjacent pocket from the pocket shown in FIGS. 13–15.

Figure 16:
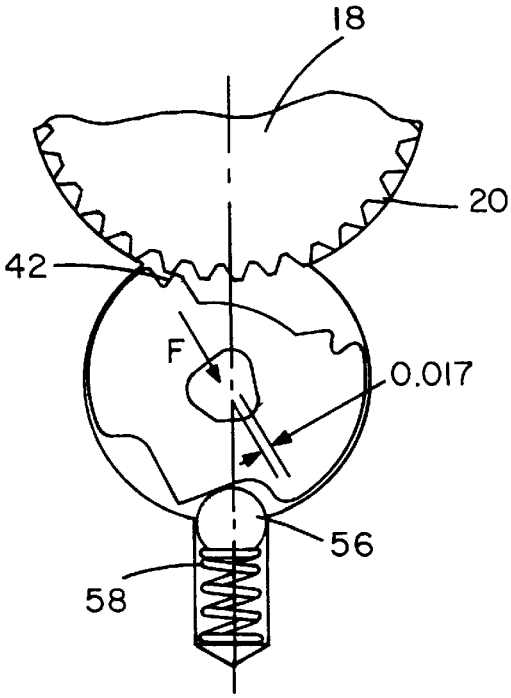
FIG. 16 PRIOR ART
FIG. 16 is a top plan view of a pawl of the prior art in partial engagement with the gear teeth.

As shown in FIG. 16, in a conventional pawl, initial contact between the pawl tooth 42' and the gear tooth 20 may create torque on the pawl counter to that produced by the detent means. In a typical pawl the force is approximately 0.017 inches displaced from the center of the pawl. The force is urging the pawl 22 in a rotative direction opposite from the direction being urged by the detent means and diminishes the torque. Alternately, the pawl may be in a neutral state because the force from the engagement of the pawl tooth 44, with the gear tooth 20 is applied at approximately the center of the pawl and is not complementary to the urging of the detent means.

Figure 17:
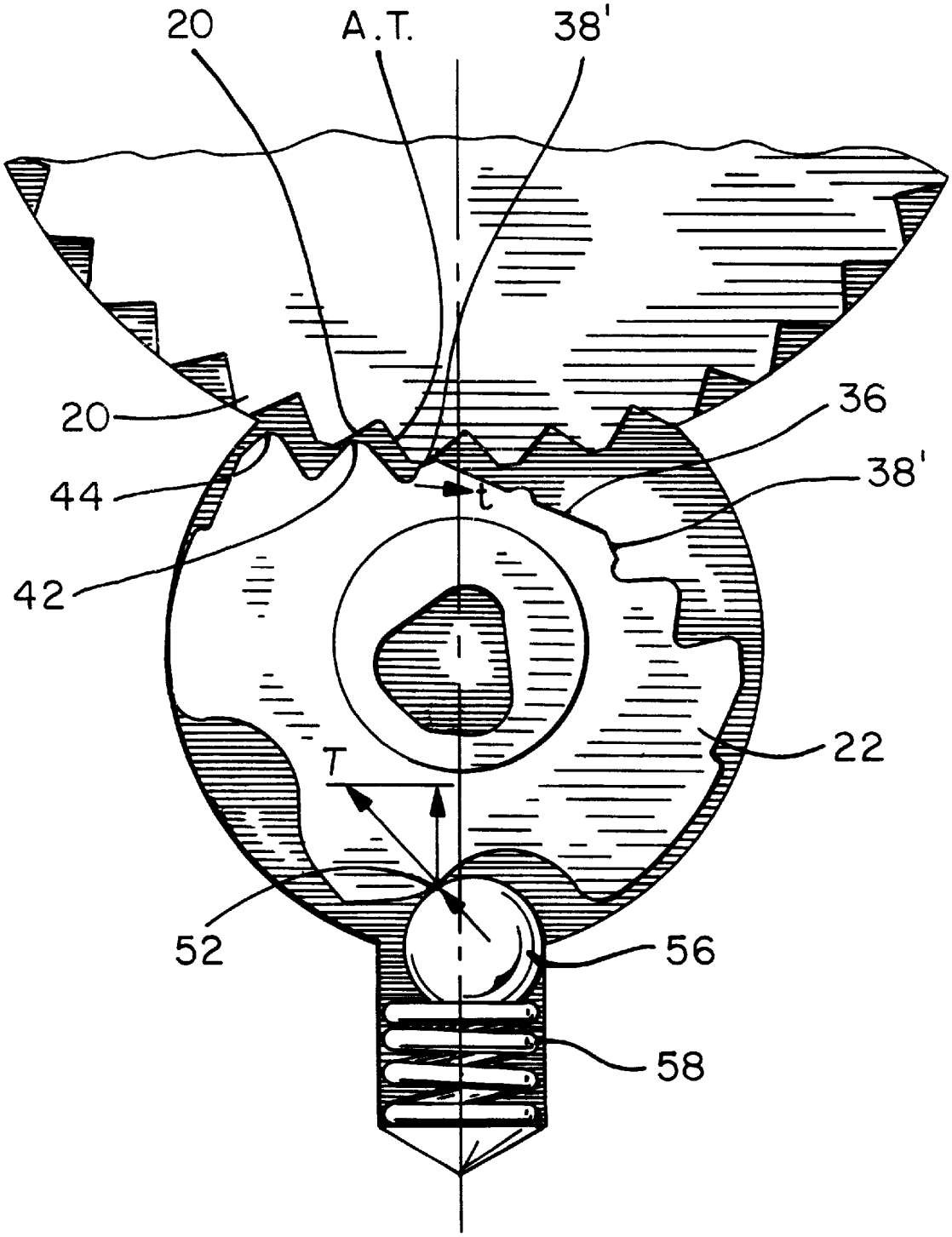
FIG. 17 is an enlarged view showing the intermediate portion of the pawl having chamfered ends to engage the gear teeth.

In an alternate embodiment of the intermediate portion 36 (FIG. 17), the ends 38 of the intermediate portion are chamfered at a predetermined angle. The chamfered end 38' serves to continue engagement with the adjacent tooth (AT) on the gear over a brief, but extended, period of time as compared to the non-chamfered end 38. This provides additional rotative torque to the pawl as shown by the arrow t which complements the torque T provided by the detent ball 56 and spring 58. The angle of the chamfer determines, to a large extent, the magnitude of the additional torque t. The chamfered angle may be 45° but is not so limited.

Figure 18:
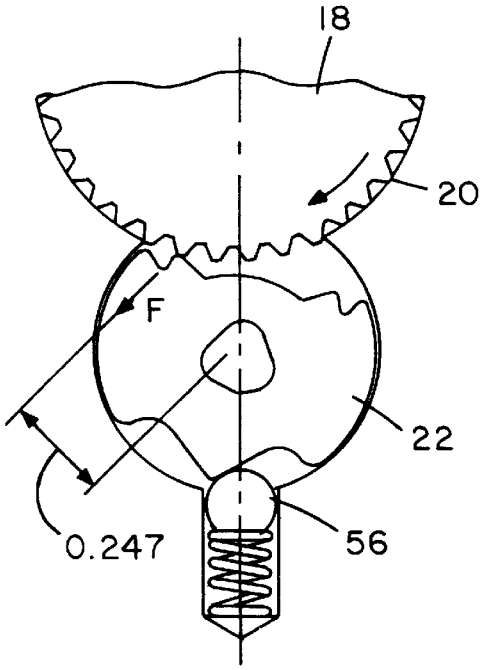
FIG. 18 PRIOR ART
FIG. 18 is a top plan view of a prior art pawl in a backswing mode.

In a conventional pawl in the backswing mode (FIG. 18) the force F applied by the gear tooth to the pawl tooth is at an angle of approximately 45° with respect to the center line of the wrench. The force is displaced by approximately 0.247 in. from the center of the pawl.

Figure 19:
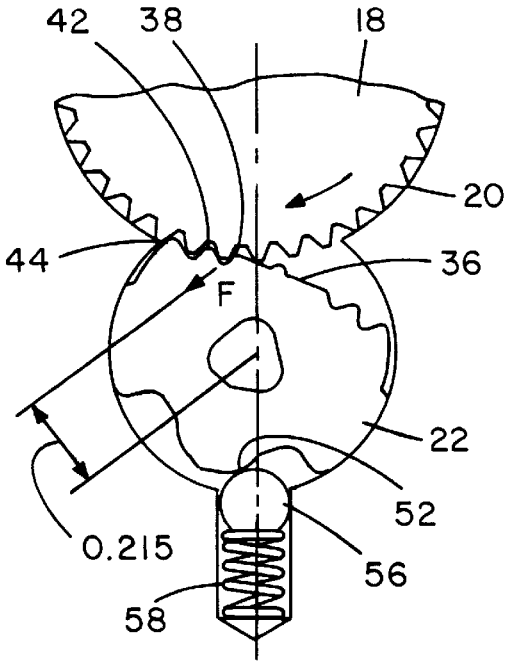
FIGS. 19–21 are a sequence of top plan views showing the backswing mode of the pawl of the present invention.
Figure 20:
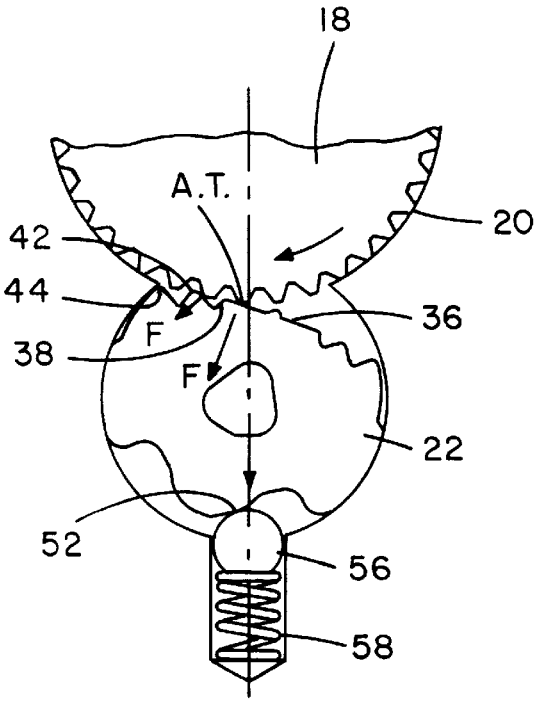
Figure 21:
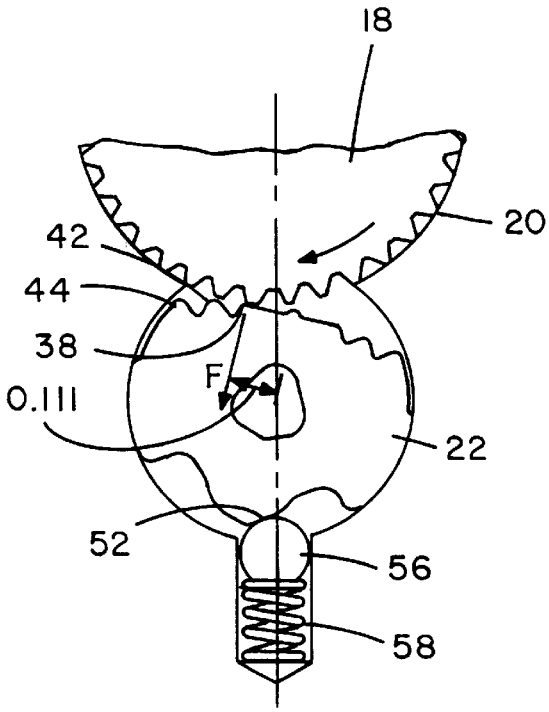

FIGS. 19–21 show the backswing of the pawl of the present invention. The force F is at an angle greater than 45° with respect to the center line of the wrench which overcomes the pawl torque produced by the detent ball 56 acting on the ramp 52 in the pocket of the pawl. The angle of the force F is more horizontal than it is vertical with respect to the center line of the wrench, i.e. it is more torque producing than translational. The force is displaced approximately 0.215 in. from the center of the pawl. As the backswing continues (FIG. 20) the adjacent tooth A.T. initiates contact with the intermediate portion 36 of the front face of the pawl 22. A force F1 is produced directed primarily toward the detent means which readily overcomes the force of the detent spring. The pawl 22 translates toward the ratchet handle. In the full backswing (FIG. 21), the force F applied to the pawl is at an angle of approximately 10°. There is very little rotative torque and most of the force is directed against the detent means.

Figure 22:
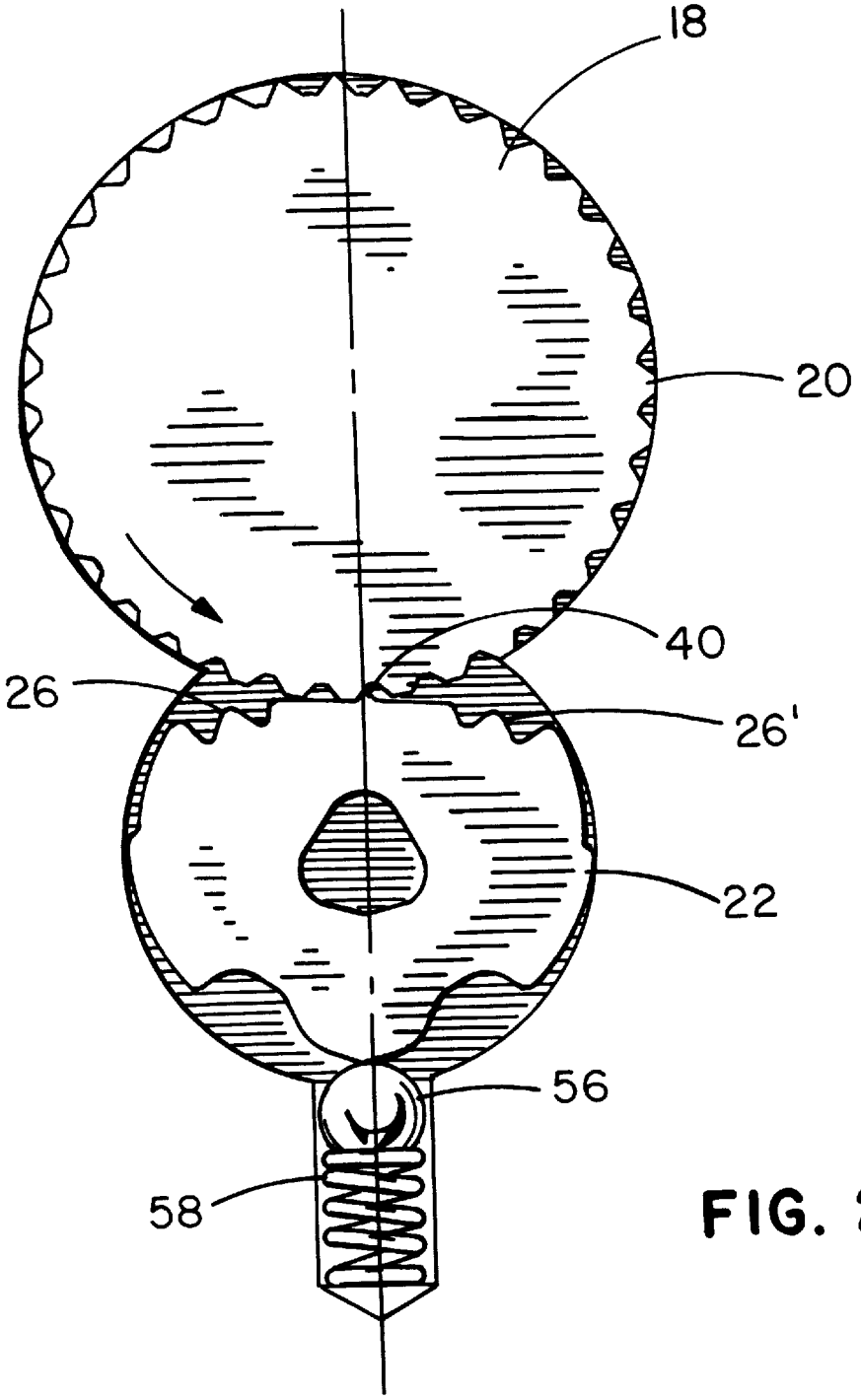
FIG. 22 is a top plan view showing the tooth on the intermediate portion of the front face of the pawl engaged with the gear tooth.

Due to the translational movement of the pawl 22 as described above, in the course of shifting the pawl between forward and reverse, it is possible for the pawl 22 to be positioned through movement of the shift lever 64 in a neutral zone from the ratchet gear 18 so that, in exceptional situations the pawl 22 is at a neutral, on-center position. Neither the sets of pawl teeth 26, 26' or the ends 38 of the portion 36 are engaging the teeth 20 on the ratchet gear 18. In this situation, the pawl 22 would be immobile and the wrench would become inoperative and unable to have the ability to have forward and reverse movement. To avoid this situation, the tooth 40 on the intermediate portion 36 has been incorporated into the pawl 22. As shown in FIG. 22, the tooth 40 engages the teeth 20 on the ratchet gear 18 when the pawl 22 has been rotated to an intermediate position between forward and reverse and, with further movement of the gear, the pawl 22 moves to re-engage the selected set of pawl teeth 26, 26' with the gear teeth. Thus, the pawl is not able to be in a neutral position and the wrench is always operative.

Figure 2:
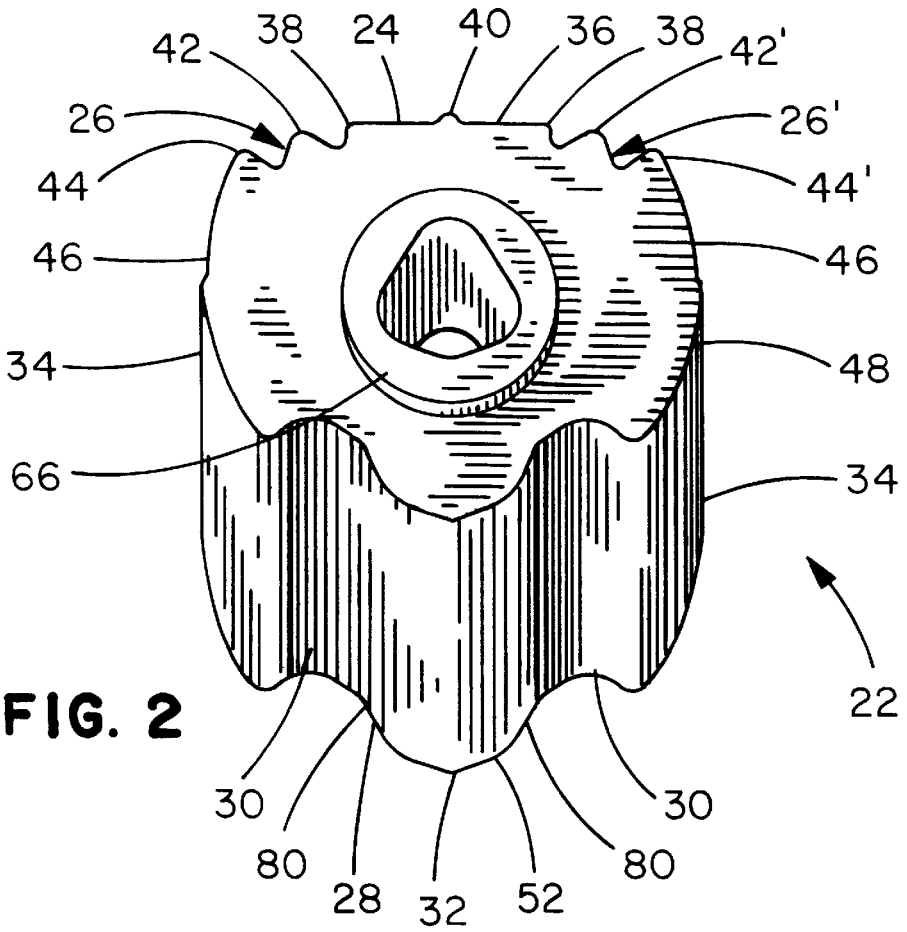
FIG. 2 is a perspective view of the pawl of the present invention showing the bottom surface and the back face of the pawl with the pockets and center ridge.
Figure 7:
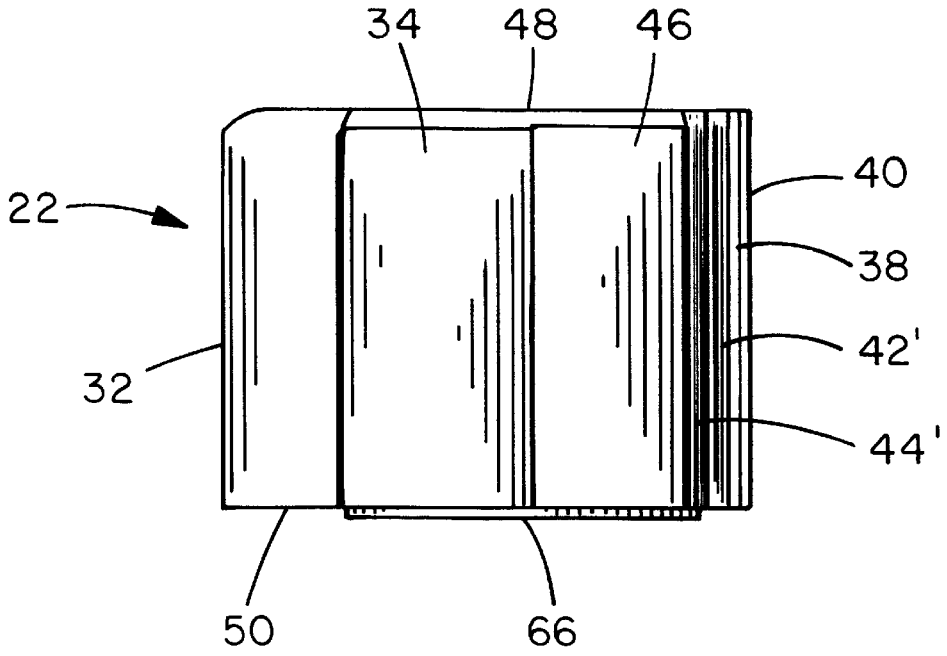
FIG. 7 is a side elevation view of the pawl of the present invention.

Furthermore, it is preferred that a spacing hub 66 be formed on the top surface 48 and/or on the bottom surface 50 of the pawl 22 (FIGS. 2, 7 and 8). The spacing hub 66 may be a boss or raised portion. It is preferred that the spacing hub be at approximately the center of the face of the pawl. The spacing hub 66 contacts a restraining member such as a cover plate 68 which is over the pawl opening 14 and ratchet gear opening 12 in the head of the wrench 10. The spacing hub 66 minimizes frictional forces between the pawl 22 and the restraining member 68. The cover plate 68 is attached to the head of the wrench with a retaining ring 70. The restraining member may also be a portion of the head of the wrench. The pawl 22 may have two spacing hubs 66, one on the top surface 48 and one on the bottom surface 50.

Figure 3:
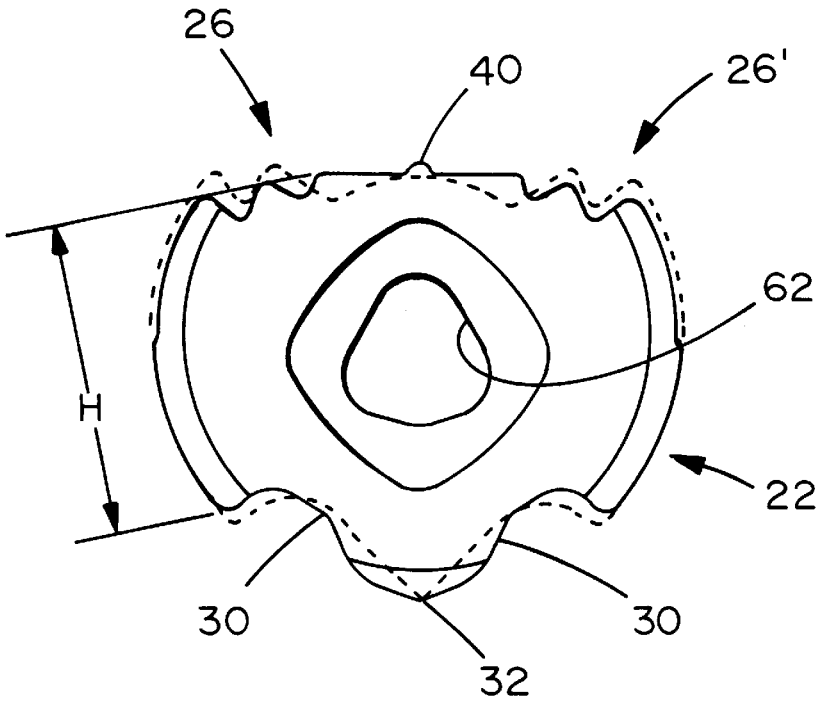
FIG. 3 is a top plan view of the pawl of the present invention superimposed on a pawl of the prior art shown in broken lines.
Figure 25:
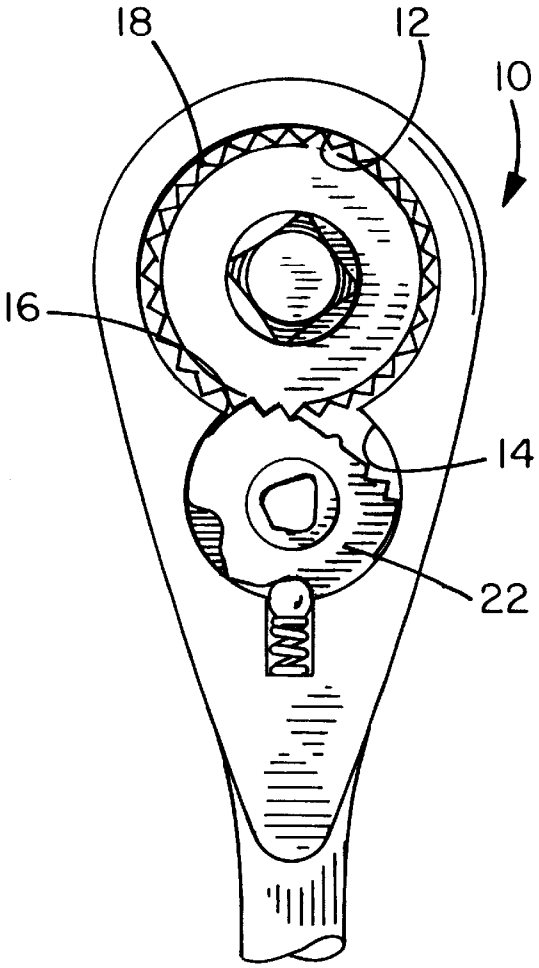
FIG. 25 shows the insertion of the ratchet gear in the ratchet gear opening with the teeth on the pawl engaging the teeth on the ratchet gear.
Figure 24:
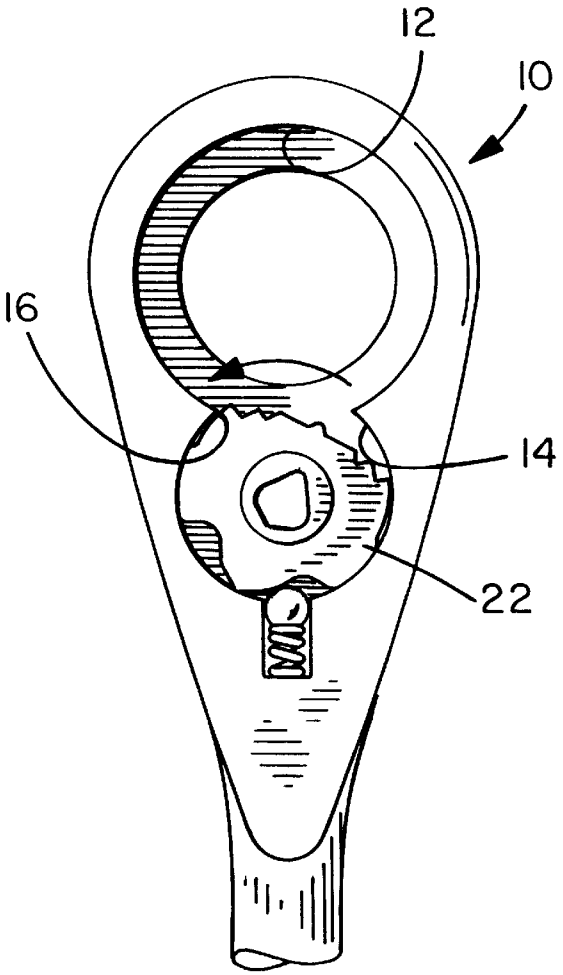
FIG. 24 shows the pawl rotated through approximately 90° to axially orient the pawl within the pawl opening and to dispose the ball of the detent means within one of the pockets on the back face of the pawl and the bore.
Figure 23:
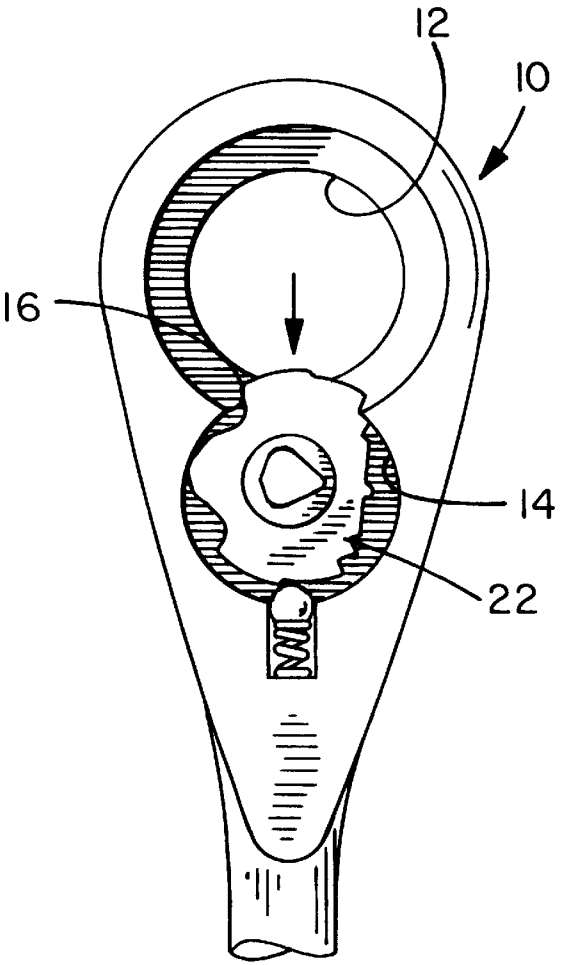
FIG. 23 shows the pawl inserted in the pawl opening with one side surface compressing the detent means and the other side surface being in the ratchet gear opening.
Figure 26:
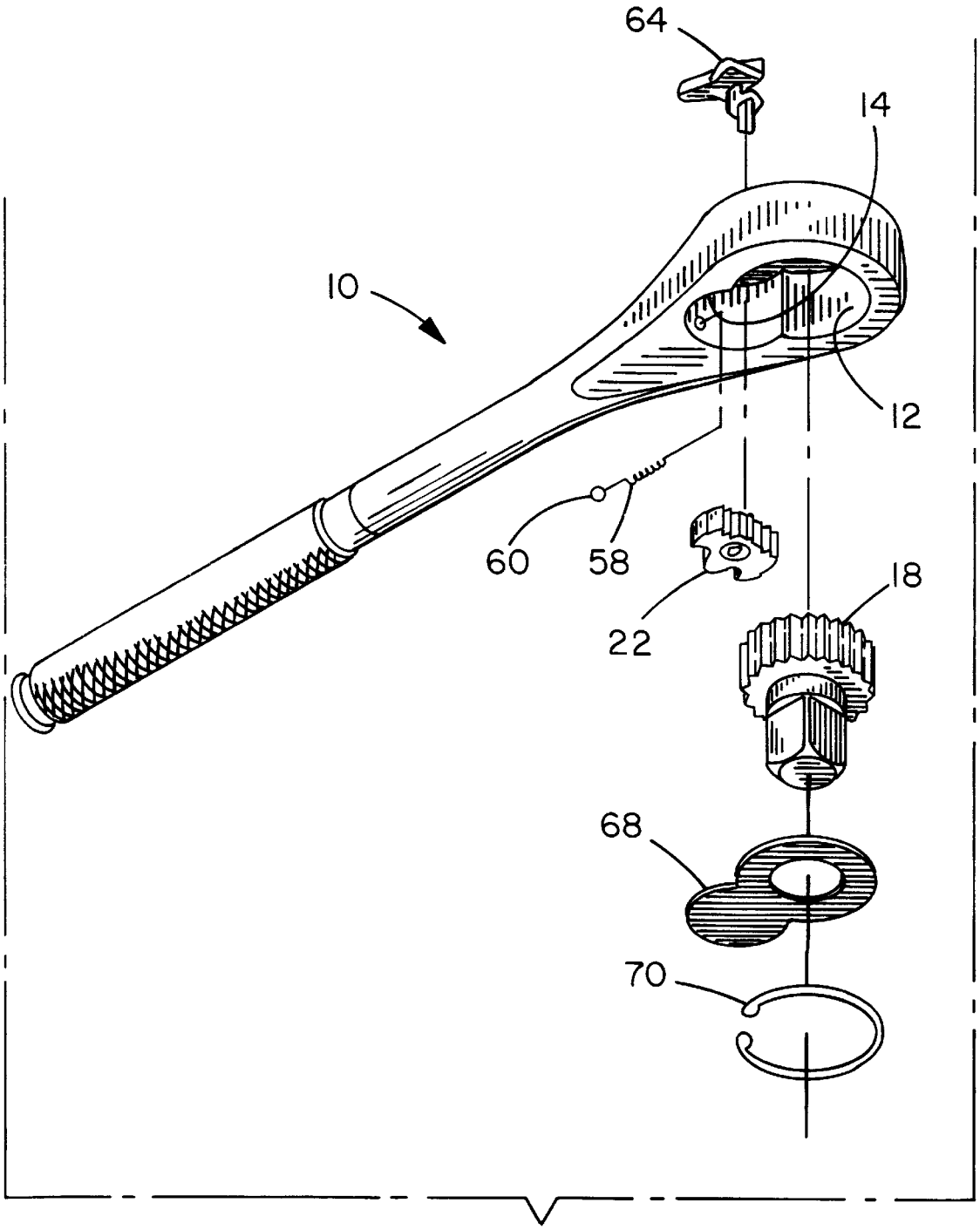
FIG. 26 is an exploded view of the ratchet wrench with the pawl of the present invention.

The distance between the front face 24 of the pawl 22 and the juncture of the back face 28 with the side surface 34 of the pawl 22 defines a height H (FIG. 3). The height H is less than the width of the interface 16 between the overlapping ratchet gear opening 12 and pawl opening 14. Thus, as shown in FIGS. 23–25, when the ratchet wrench 10 is held in an upright position with the ratchet gear opening 12 disposed above the pawl opening 14, the pawl 22 may be easily inserted in the head of the wrench 10 without using special tooling to retain the detent ball 56 and spring 58 in the bore 60 in the handle. The pawl 22 is placed in the pawl opening 14 such that one side surface 34 of the pawl is disposed in the ratchet gear opening 12 and the opposite side surface 34 of the pawl 22 is oriented toward the detent ball 56 disposed on the spring 58 in the bore 60 in the handle. The pawl 22 is moved toward the handle to compress the spring 58 and insert the ball into the bore 60 (note arrow in FIG. 23). The pawl 22 is then rotated (note arrow in FIG. 24) so that the pawl 22 is completely disposed within the pawl opening 14 with the detent ball 56 disposed within one of the pockets 30 on the back face 28 of the pawl 22 and the front face 24 of the pawl 22 oriented toward the ratchet gear opening 12. The ratchet gear 18 is inserted into the ratchet gear opening 12 with the pawl teeth 26 or 26' engaging the ratchet gear teeth 20 (FIG. 25). The reversing lever 64 can be inserted before or after the pawl is inserted into the handle. This simplified assembly is performed without any special tooling and can reduce costs of the ratchet wrenches while simultaneously improving safety by reducing problems with ejecting detent balls and springs.

Figure 27:
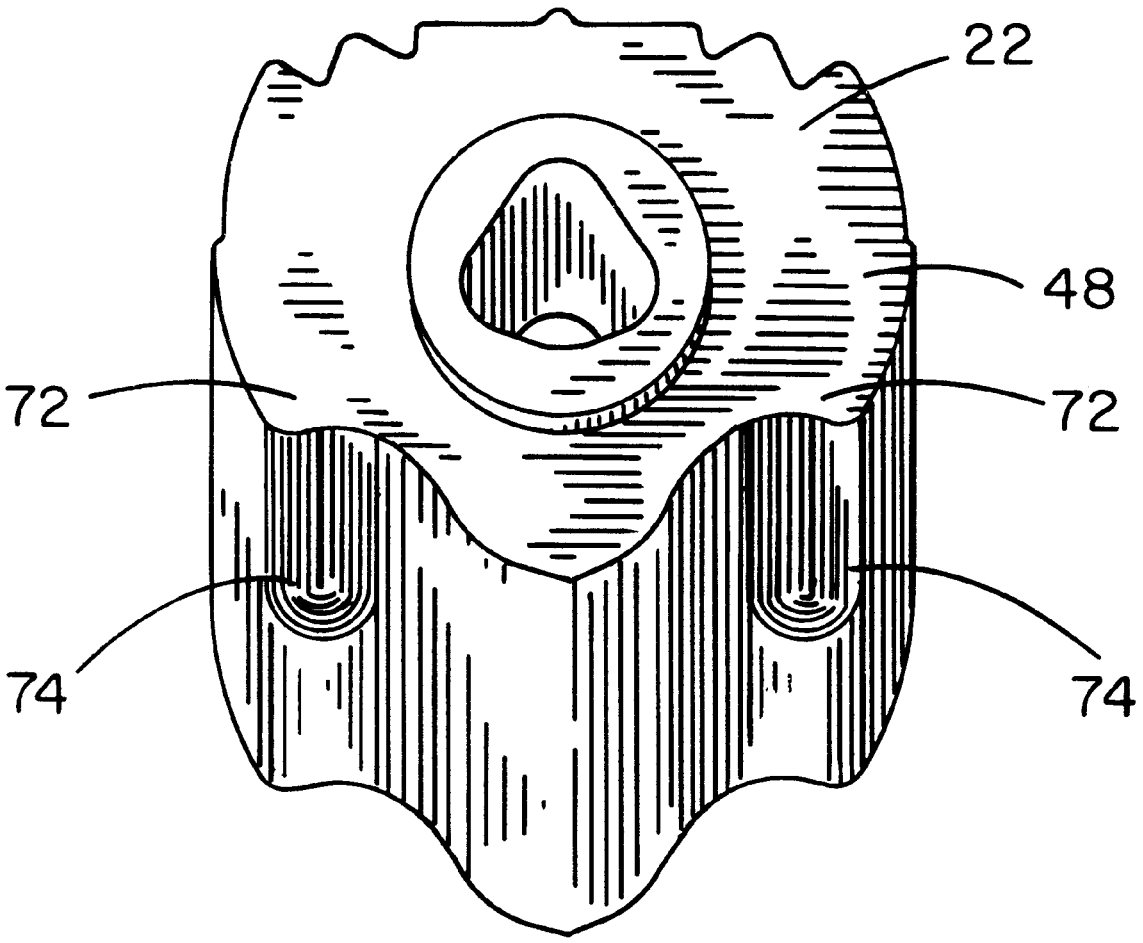
FIG. 27 is a perspective view of an alternative embodiment of the pawl showing a furrow in each pocket on the back face of the pawl.
Figure 28:
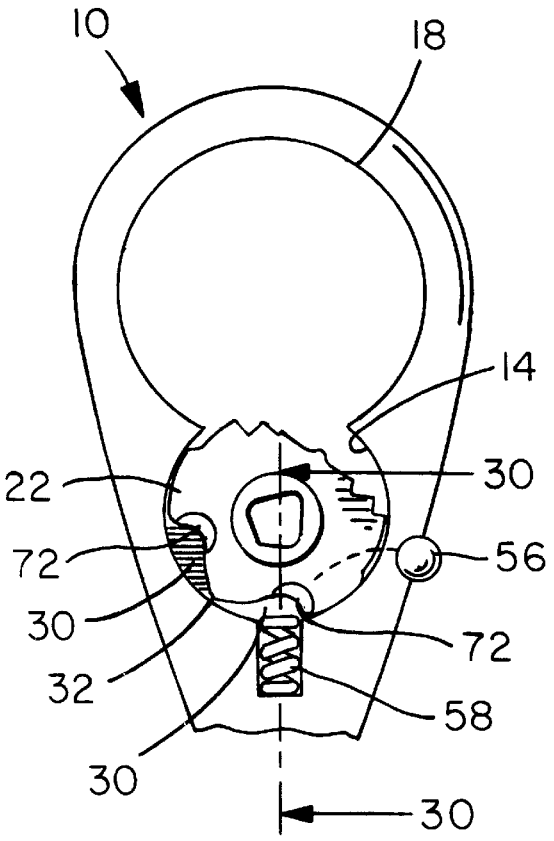
FIG. 28 is a bottom plan view of the opening in the wrench with the pawl of FIG. 27 disposed in the pawl opening and the detent ball poised above the furrow in the pawl.
Figure 29:
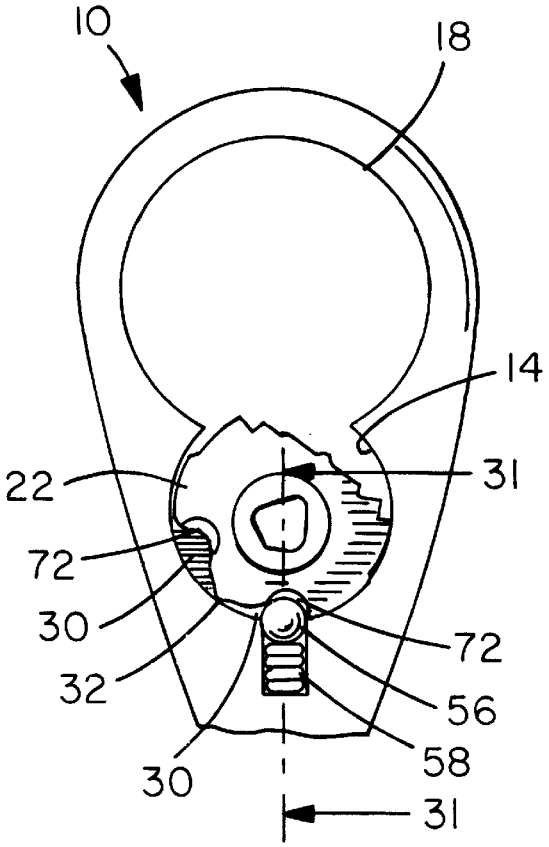
FIG. 29 is the view of FIG. 28 showing the detent ball in the bore contacting the detent spring and urged against the pawl after the ball has descended the furrow and the ratchet gear has been inserted.
Figure 30:
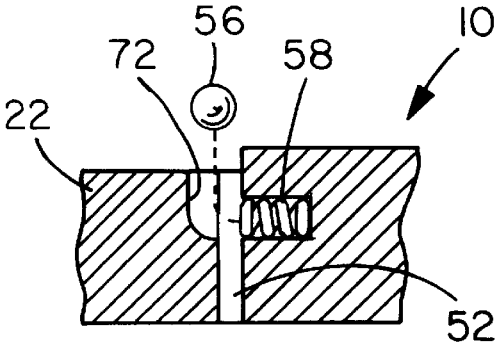
FIG. 30 is a cross-sectional view across the lines 30—30 of FIG. 28 showing the ball about to be introduced in the furrow in the pawl prior to the ball being received in the bore containing the spring.
Figure 31:
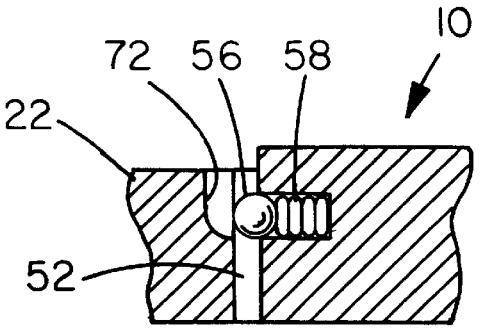
FIG. 31 is a cross-sectional view across lines 31—31 of FIG. 29 showing the ball received in the bore with the detent spring.

In another embodiment, the pawl 22 further has a furrow 72 formed in at least one of the pockets and preferably, in each pocket 30 on the back face 28 of the pawl. Each furrow 72 extends from the bottom surface 50 of the pawl 22 toward the top surface (FIG. 27). Preferably, the innermost surface 74 of each furrow 72 is curved outwardly from the pawl 22 toward the back face 28 of the pawl. As shown in FIG. 28, the pawl 22 is moved or urged toward the ratchet gear opening 12 due to the relief surfaces 46 which affords a small clearance between the pawl 22 and the pawl opening 14 near the ratchet gear opening 12. The pawl 22 translates within the pawl opening 14. Pawls which do not have the relief surfaces are closely fitted in the pawl opening and translation is severely limited. One of the furrows 78 is displaced sufficiently from the bore 60 so that the detent ball 56 may be introduced into the furrow 72. The furrow 72 is aligned with the bore 60. The detent ball 56 descends to the innermost surface 74 and, due to the curvature, is directed toward the bore 60 in which the spring 58 has previously been disposed (FIGS. 27–30). The pawl 72 is then moved backwardly toward the handle. In this manner, due to the rotation and translation of the pawl 22 and the furrow 72, the detent ball 56 may be inserted into the bore 60 after the pawl 22 is disposed into the pawl opening without use of special tools. Consequently, the user can easily assemble and disassemble the ratchet wrench and there is a reduction in assembly costs and an increase in safety.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A pawl for use in a ratchet wrench having a handle and a head connected thereto, the ratchet wrench having a gear opening and a pawl opening in the head of the ratchet wrench, the pawl opening having an inner wall, a ratchet gear being disposed in the gear opening and a pawl being disposed in the pawl opening juxtapositioned to one another with the pawl proximal to the handle, a detent means contacting the pawl to urge the pawl into engagement with the ratchet gear, the pawl comprising:

a front face having at least a first tooth and a spaced-apart at least a second tooth, a back face, a pair of opposite side surfaces between the front face and the back face, each side surface of the pawl having a relief surface formed thereon, the respective relief surfaces each extending from the front face of the pawl between the front face and the back face of the pawl providing increased forward radial clearance between the respective relief surfaces and the inner wall of the opening in the head, wherein dirt within the head of the wrench between the respective relief surfaces and the wall of the opening in the head is less frictionally effective, and the relief surfaces promoting longitudinal translational movement of the pawl between the detent means and the ratchet gear within the pawl opening.

2. The pawl of claim 1, wherein the pawl has a top surface and an opposite bottom surface, the relief surfaces on the respective sides of the pawl extending between the top surface and the bottom surface.

3. The pawl of claim 1, further comprising an intermediate portion being formed on the front face of the pawl between the spaced-apart teeth, the intermediate portion having opposite ends adjacent to the respective at least a first tooth and the at least a second tooth, the opposite ends of the intermediate portion forming respective teeth, the teeth on the opposite ends of the intermediate portion respectively initially engaging the ratchet gear when the wrench is used in a forward and reverse direction, the teeth on the opposite ends of the intermediate portion acting at a greater effective radius as compared to the respective at least a first tooth and the at least a second tooth on the front face of the pawl, wherein enhanced rotative torque is provided to the pawl to supplement the action of the detent means.

4. The pawl of claim 3, wherein the opposite ends of the intermediate portion are chamfered such that additional rotative torque is applied to the pawl.

5. The pawl of claim 4, further comprising at least one tooth being formed on the intermediate portion of the front face of the pawl at an approximate mid-point of the intermediate portion, wherein the at least one tooth on the intermediate portion engages the ratchet gear when the pawl is approximately at a neutral, on-center position within the opening in the head of the wrench, preventing the pawl from being immobile within the opening in the head.

6. The pawl of claim 3, wherein the at least a first tooth and the at least a second tooth on the front face of the pawl each are disposed rearwardly of the intermediate portion.

7. The pawl of claim 6, further comprising a third tooth spaced apart from and rearwardly of the at least a first tooth and a fourth tooth spaced apart from and rearwardly of the at least a second tooth, the third and fourth teeth being distal from the intermediate portion.

8. The pawl of claim 1, further comprising:

the back face having a pair of adjacent pockets separated by a center ridge, each pocket in the back face having a ramp formed therein adjoining the center ridge extending inwardly into the respective pocket and joining a concave portion of each pocket, each concave portion terminating at the respective side surface of the pawl, and the detent means resiliently extending partially into the pawl opening, the detent means applying force against the ramp in the respective pocket in the back face of the pawl and urging the pawl teeth into positive engagement with the ratchet gear.

9. The pawl of claim 8, wherein the ramp is convex.

10. The pawl of claim 8, wherein the ramp has at least one non-arcuate segment.

11. The pawl of claim 8, further comprising a non-arcuate section disposed between the ramp and the concave portion of each pocket.

12. The pawl of claim 11, wherein the non-arcuate section in each pocket is disposed of an angle of approximately 24° with respect to a center line through the pawl.

13. The pawl of claim 1, wherein the opening in the head of the wrench has a ratchet gear opening and a pawl opening, the ratchet gear opening overlapping the pawl opening and defining an interface having a width, the ratchet gear being disposed in the ratchet gear opening, the pawl being disposed in the pawl opening, a height being defined between the front face of the pawl and a juncture of the back face with the side surface of the pawl, the height on the pawl being less than the width of the interface of the overlapping openings in the head, wherein the pawl may be disposed in the pawl opening with one of the sides of the pawl extending into the ratchet gear opening and the other side of the pawl contacting the detent means disposed in a bore formed in the handle communicating with the pawl opening such that the pawl may be moved toward the handle and rotated through approximately 90° to dispose the pawl completely within the pawl opening such that the detent means is retained in the bore avoiding special tooling to install the detent means.

14. The pawl of claim 1, further comprising the pawl having at least one furrow formed on the back face of the pawl, the at least one furrow extending from a bottom surface toward a top surface of the pawl, the at least one furrow having an innermost surface curved outwardly toward the back face of the pawl, wherein the pawl may be moved away from the handle of the ratchet wrench, a detent ball may be introduced into the at least one furrow, the at least one furrow aligned with a bore formed in the handle, the detent ball moving to the curved innermost surface and being directed into the bore in the handle in which a spring has been pre-positioned, such that the pawl may be moved to capture the ball in the bore and special tools to insert the detent means in the bore are avoided.

15. The pawl of claim 1, further comprising the pawl having a top and a bottom surface, a spacing hub formed on at least one of the surfaces of the pawl wherein the spacing hub contacts a restraining member in the wrench and minimizes friction between the pawl and the restraining member.

16. The pawl of claim 1, wherein the pawl has a center, a first portion of the side surface of the pawl being formed at a first radius from the center and adjoining the teeth on the pawl and a second portion of the side surface of the pawl being formed at a second radius from the center and adjoining the back face on the pawl, the second radius being greater than the first radius and the first radius defining the relief surfaces on the side surfaces of the pawl.

17. The pawl of claim 1, wherein the pawl has a center, a first portion of the side surface of the pawl being non-arcuate, adjoining the teeth on the pawl and extending toward the back face of the pawl to a second portion of the side surface of the pawl, the second portion of the side surface of the pawl being formed at a radius from the center and adjoining the back face on the pawl, defining the relief surfaces on the side surfaces of the pawl.

18. A pawl for use in a ratchet wrench having a handle and a head connected thereto, the ratchet wrench having an opening in a head of the ratchet wrench, a ratchet gear and a pawl being disposed in the opening juxtapositioned to one another with the pawl proximal to the handle, a detent means contacting the pawl to urge the pawl into engagement with the ratchet gear, the pawl comprising:

a front face having a first set of teeth and a spaced-apart second set of teeth, a back face having a pair of adjacent pockets separated by a center ridge, and a pair of opposite side surfaces between the front face and the back face, an intermediate portion being formed on the front face of the pawl between the sets of teeth, the intermediate portion having opposite ends adjacent to the respective sets of teeth, the opposite ends of the intermediate portion forming respective teeth, the teeth on the opposite ends of the intermediate portion respectively initially engaging the ratchet gear when the wrench is used in a forward and a reverse direction, the teeth on the opposite ends of the intermediate portion acting at a greater effective radius as compared to the respective sets of teeth on the front face of the pawl, wherein enhanced rotative torque is provided to the pawl to supplement the action of the detent means.

19. The pawl of claim 18, wherein the opposite ends of the intermediate portion are chamfered such that additional rotative torque is applied to the pawl.

20. The pawl of claim 18, further comprising at least one tooth formed on the intermediate portion of the front face of the pawl at an approximate mid-point of the intermediate portion, wherein, the pawl translates within the pawl opening, the at least one tooth on the intermediate portion engaging the ratchet gear when the pawl is approximately at a neutral on-center position within the opening in the head of the wrench thereby preventing the pawl from being immobile within the opening.

21. The pawl of claim 18, wherein the first set of teeth and the second set of teeth on the front face of the pawl each are comprised of a first tooth proximal and rearward of the intermediate portion and a spaced-apart second tooth distal from the intermediate portion and rearward of the first tooth, the pawl having translational movement within the opening in the head of the wrench.

22. The pawl of claim 18, further comprising:

each pocket in the back face having a ramp formed therein adjoining the center ridge extending inwardly into the respective pocket and joining a concave portion of each pocket, each concave portion terminating at the respective side surface of the pawl, and the detent means disposed in the handle and extending partially into the pawl opening, the detent means applying force against the ramp in the respective pocket in the back face of the pawl and urging the pawl teeth into positive engagement with the ratchet gear.

23. The pawl of claim 22, further comprising a non-arcuate section disposed between the ramp and the concave portion of each pocket.

24. The pawl of claim 23, wherein the non-arcuate section is disposed at an angle of approximately 24° with respect to a center line through the pawl.

25. The pawl of claim 18, further comprising:

each side surface of the pawl having a relief surface formed thereon, the respective relief surfaces each extending from the front face of the pawl between the front face and the back face of the pawl, wherein dirt within the head of the wrench passes between the respective relief surfaces and the opening in the head and is less frictionally effective, the relief surfaces promoting longitudinal translational movement of the pawl between the detent means and the ratchet gear within the pawl opening.

26. The pawl of claim 25, wherein the pawl has a top surface and an opposite bottom surface, the relief surfaces on the respective sides of the pawl extending between the top surface and the bottom surface.

27. The pawl of claim 18, wherein opening in the head of the wrench has a ratchet gear opening and a pawl opening, the ratchet gear opening overlapping the pawl opening and defining an interface having a width, the ratchet gear being disposed in the ratchet gear opening, the pawl being disposed in the pawl opening, a height being defined between the front face of the pawl and a juncture of the back face with the side surface of the pawl at the termination of the concave portion of the pocket, the height on the pawl being less than the width of the intersection of the overlapping openings, wherein the pawl may be disposed in the pawl opening with one of the sides of the pawl extending into the ratchet gear opening and the other side of the pawl contacting the detent means disposed in a bore formed in the handle communicating with the pawl opening, such that the pawl may be moved toward the handle and rotated through approximately 90° to dispose the pawl completely within the pawl opening such that the detent means is retained in the bore avoiding special tooling to install the detent means.

28. The pawl of claim 27, wherein the pawl is journalled in the pawl opening.

29. The pawl of claim 18, further comprising the pawl having at least one furrow formed on the back face of the pawl, the at least one furrow extending from a bottom surface toward a top surface of the pawl, the at least one furrow having an innermost surface curved outwardly toward the back face of the pawl, wherein the pawl may be moved away from the handle of the ratchet wrench and a detent ball may be introduced into the at least one furrow, the at least one furrow aligned with a bore formed in the handle, the detent ball moving to the curved innermost surface and being directed into the bore in the handle in which a spring has been pre-positioned, such that the pawl may be moved to capture the ball in the bore and special tools to insert the detent means in the bore are avoided.

30. The pawl of claim 18, further comprising the pawl having a top and a bottom surface, a spacing hub formed on at least one of the surfaces of the pawl wherein the spacing hub contacts a restraining member in the wrench and minimizes friction between the pawl and the restraining member.

31. A pawl for use in a ratchet wrench, the ratchet wrench having a handle connected to a head, the ratchet wrench having a ratchet gear opening in the head and a communicating pawl opening in the head of the ratchet wrench, a bore formed in the handle communicating with the pawl opening, a ratchet gear being disposed in the ratchet gear opening, a pawl being disposed in the pawl opening, the pawl comprising:

a front face having a first set of teeth and a spaced-apart second set of teeth, a back face having a pair of adjacent pockets separated by a center ridge, a pair of opposite side surfaces between the front face and the back face, at least one furrow formed on the back face of the pawl, the at least one furrow extending from a bottom surface toward a top surface of the pawl, the at least one furrow having an innermost surface curved outwardly toward the back face of the pawl, wherein the pawl in the pawl opening may be moved away from the handle, the at least one furrow aligned with the bore in the handle, a detent ball may be introduced into the at least one furrow, the detent ball moving to the curved innermost surface and being directed into the bore in the handle in which a spring has been pre-positioned, such that the pawl may be moved to capture the ball in the bore and special tools to insert the detent means in the bore are avoided.

32. A ratchet wrench having a handle and a head connected thereto, an opening being formed in the head of the wrench, a ratchet gear and a pawl being disposed adjacent to one another in the opening, the pawl comprising:

an upper surface and a lower surface, an axial opening formed in the upper surface of the pawl to receive therein a reversing lever, a spacing hub formed on the lower surface of the pawl at approximately a center of the lower surface, a cover plate covering the opening in the head of the ratchet wrench to retain the ratchet gear and the pawl within the opening, the spacing hub on the pawl resting on an inner surface of the cover plate and minimizing friction between the pawl and the cover plate.

33. In a ratchet wrench having a housing and further having a pawl engaging a ratchet gear in the housing for selective "forward" and "reverse" operation of the ratchet wrench, respectively, the improvement wherein the pawl has a front portion confronting the ratchet gear and an opposite rear portion and further has a pair of cylindrical surfaces engaging a circular opening in the housing for rotatably journaling the pawl in the ratchet wrench and providing good bearing support during the initiation of pawl rotation, and at least one of the cylindrical surfaces of the pawl being cut away to form a relief extending rearwardly from the front portion of the pawl, thereby providing for the passage of dirt between the pawl and the opening in the housing and promoting longitudinal translational movement of the pawl toward and away from the ratchet gear.

34. The improvement of claim 33, wherein each of the cylindrical surfaces is cut away to form the relief extending to an approximate mid-point of the cylindrical surface.

35. The improvement of claim 34, wherein the relief terminates in a shoulder formed on the cylindrical surface.

36. The improvement of claim 34, wherein the relief diminishes rearwardly from the front portion of the pawl.

37. The improvement of claim 33, further including a substantially-flat face on the front portion of the pawl, and a tooth on the face substantially centrally thereof, thereby facilitating a lateral translational movement of the pawl within the opening as the pawl completes its rotation within the opening, and thereby assuring more effective engagement between the pawl and the ratchet gear.

38. In a ratchet wrench having a handle connected to a head, the head having a ratchet gear opening and a pawl opening formed therein, a ratchet gear having circumferential gear teeth being disposed in the ratchet gear opening and a pawl being disposed in the pawl opening, the improvement wherein the pawl has a front face confronting the ratchet gear, the front face of the pawl having at least one tooth formed on a first end of the front face and at least one tooth formed on an opposite second end of the front face, an intermediate portion of the front face being between the first end and the second end of the front face, a protrusion being formed substantially centrally of the intermediate portion of the front face, wherein the protrusion on the intermediate portion engages the teeth on the ratchet gear when the pawl is approximately at a neutral, on-center position within the pawl opening in the head of the wrench, preventing the pawl from being immobile within the pawl opening in the head.

39. The ratchet wrench of claim 38, wherein the intermediate portion of the front face of the pawl is non-arcuate.

40. The ratchet wrench of claim 38, wherein the protrusion on the intermediate portion of the front face of the pawl is a tooth.

* * * * *